US010438557B2

(12) United States Patent
Wang et al.

(10) Patent No.: US 10,438,557 B2
(45) Date of Patent: Oct. 8, 2019

(54) VOLTAGE COMPENSATION CIRCUIT AND VOLTAGE COMPENSATION METHOD THEREOF, DISPLAY PANEL, AND DISPLAY APPARATUS

(71) Applicants: BOE TECHNOLOGY GROUP CO., LTD., Beijing (CN); BEIJING BOE DISPLAY TECHNOLOGY CO., LTD., Beijing (CN)

(72) Inventors: Jianming Wang, Beijing (CN); Liugang Zhou, Beijing (CN); Shou Li, Beijing (CN); Luqiang Guo, Beijing (CN); Jian Zhang, Beijing (CN); Chao Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/720,109

(22) Filed: Sep. 29, 2017

(65) Prior Publication Data

US 2018/0137832 A1 May 17, 2018

(30) Foreign Application Priority Data

Nov. 17, 2016 (CN) ..... 2016 1 1025828

(51) Int. Cl.
*G09G 3/36* (2006.01)

(52) U.S. Cl.
CPC ..... *G09G 3/3696* (2013.01); *G09G 3/3674* (2013.01)

(58) Field of Classification Search
None
See application file for complete search history.

(56) References Cited

U.S. PATENT DOCUMENTS

2007/0077033 A1* 4/2007 Shirai ..... G09G 5/003 386/224
2015/0356951 A1* 12/2015 Wang ..... G09G 5/18 345/213
2016/0125832 A1* 5/2016 Hwang ..... G09G 3/3696 345/212
2017/0223298 A1* 8/2017 Shiohara ..... H04N 5/225

* cited by examiner

*Primary Examiner* — Amr A Awad
*Assistant Examiner* — Donna V Lui
(74) *Attorney, Agent, or Firm* — Nath, Goldberg & Meyer; Joshua B. Goldberg

(57) ABSTRACT

Provided are voltage compensation circuit, voltage compensation method thereof, display panel and display apparatus. The voltage compensation circuit includes counting unit, voltage generation unit, compensation voltage output unit and power supply unit; the counting unit is connected with timing control unit of a display panel and the voltage generation unit, and configured to count rising edges output from the timing control unit and output corresponding control signal based on the counted number of rising edges; the voltage generation unit is connected with the compensation voltage output unit and configured to output corresponding control voltage based on the control signal output from the counting unit; the compensation voltage output unit is connected with feedback terminal and voltage output terminal of the power supply unit and low level terminal, and configured to output corresponding compensation voltage to the voltage output terminal based on the control voltage output from the voltage generation unit.

15 Claims, 3 Drawing Sheets

VOLTAGE COMPENSATION CIRCUIT AND VOLTAGE COMPENSATION METHOD THEREOF, DISPLAY PANEL, AND DISPLAY APPARATUS

CROSS-REFERENCE TO RELATED APPLICATION

This application claims priority to Chinese Patent Application No. 201611025828.8, filed on Nov. 17, 2016, the contents of which are incorporated herein by reference in entirety.

FIELD

The present disclosure relates to the field of display technologies, and particularly, to a voltage compensation circuit, a voltage compensation method thereof; a display panel, and a display apparatus.

BACKGROUND

Currently, resolution of liquid crystal display becomes increasingly high and size of liquid crystal display becomes increasingly large. As such, for a liquid crystal display panel mainly driven by using thin film transistors (TFTs), equivalent resistance and capacitance in the equivalent transmission path are increasingly large, resulting in abnormal (also known as RC Delay in the art) in data signals transmitted through a source driver IC and gate scanning signals output from a gate driver IC.

Specifically, assuming that a progressive scanning from top to bottom is performed in the liquid crystal display panel, RC Delay occurred at a side of the liquid crystal display panel proximal to the source driver IC is relatively small, so that charging rate for pixels of the display panel at this side is sufficient and part of an image at this side is displayed in a higher brightness. On the other hand, RC Delay at a side of the liquid crystal display panel distal to the source driver IC is relatively large, so that charging rate for pixels of the display panel at the side is poor, and thus part of an image at the side is displayed in a lower brightness and other defects in image display due to insufficient charging rate may also occur. Therefore, there is a problem in which brightness of the image displayed on the display panel is not uniform in overall.

SUMMARY

An embodiment the present disclosure provides a voltage compensation circuit, including a counting unit, a voltage generation unit, a compensation voltage output unit and a power supply unit; wherein the counting unit is connected with a timing control unit of a display panel and the voltage generation unit, and configured to count rising edges output from the timing control unit and output a corresponding control signal based on the counted number of the rising edges;

the voltage generation unit is connected with the compensation voltage output unit, and configured to output a corresponding control voltage based on the control signal output from the counting unit; and the compensation voltage output unit is connected with a feedback terminal and a voltage output terminal of the power supply unit and a low level terminal, and configured to output a corresponding compensation voltage to the voltage output terminal based on the control voltage output from the voltage generation unit.

Optionally, the compensation voltage output unit includes a first resistor, a second resistor, a third resistor, a fourth resistor and a bipolar-junction transistor; wherein a first end of the first resistor is connected with the voltage output terminal of the power supply unit, and a second end of the first resistor is connected with a first end of the second resistor;

a second end of the second resistor is connected with a second end of the third resistor and the low level terminal;

a first end of the third resistor is connected with a second electrode of the bipolar-junction transistor, and a second end of the third resistor is connected with the low level terminal;

a first end of the fourth resistor is connected with the voltage generation unit, and a second end of the fourth resistor is connected with a control electrode of the bipolar-junction transistor; and a first electrode of the bipolar-junction transistor is connected with the feedback terminal of the power supply unit.

Optionally, a voltage at the feedback terminal of the power supply unit has a fixed value.

Further optionally, the voltage at the feedback terminal of the power supply unit is 1.25V.

Optionally, the counting unit is further configured to clear the counted number of the rising edges output from the timing controll unit upon receiving a start vertical (STV) signal from the timing control unit.

An embodiment of the present disclosure provides a voltage compensation method of a voltage compensation circuit, wherein the voltage compensation circuit is any of the circuits described above, and the voltage compensation method includes:

counting rising edges output from the timing control unit, and outputting a corresponding control signal based on the counted number of the rising edges;

outputting a corresponding control voltage based on the control signal output from the counting unit; and outputting a corresponding compensation voltage to the voltage output terminal based on the control voltage output from the voltage generation unit.

Optionally, the voltage compensation method further includes:

clearing, by the counting unit, the counted number of the rising edges output from the timing control unit when the counting unit receives a start vertical signal from the timing control unit.

An embodiment of the present disclosure provides a display panel including any of the voltage compensation circuits described above.

An embodiment of the present disclosure provides a display apparatus including the display panel described above.

DETAILED DESCRIPTION

To make those skilled in the art better understand the technical solutions of the present disclosure, the present disclosure will be described below in detail in conjunction with the accompanying drawings and specific implementations.

Figure 1:
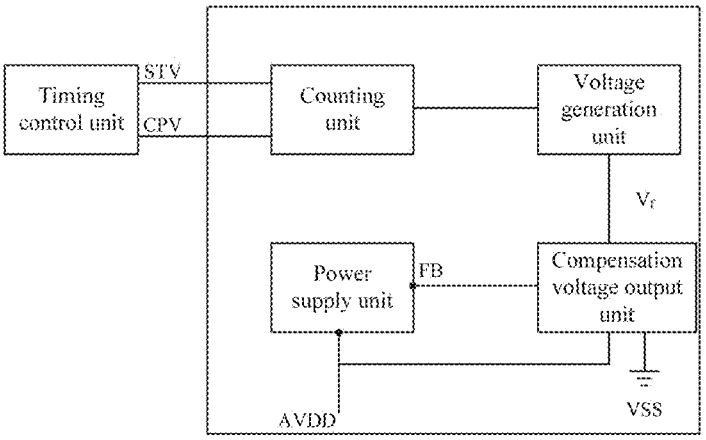
FIG. 1 is a schematic diagram illustrating a structure of a voltage compensation circuit (encircled by the dotted box) according to an embodiment of the present disclosure.
Figure 2:
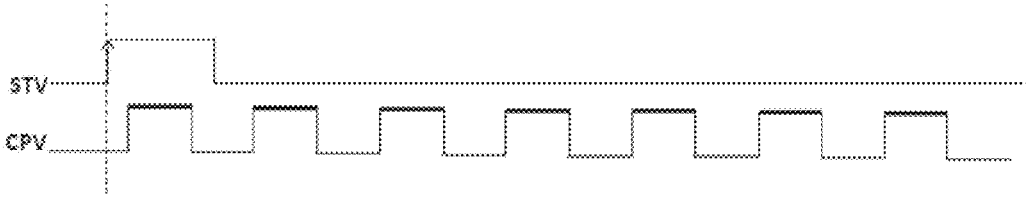
FIG. 2 is a schematic diagram illustrating a timing signal output from a timing control unit of a display panel according to an embodiment of the present disclosure.
Figure 3:
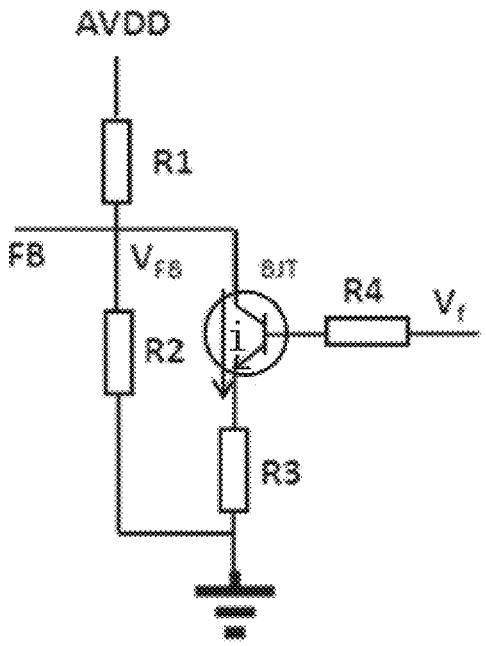
FIG. 3 is a schematic diagram illustrating a specific structure of a compensation voltage output unit of a voltage compensation circuit according to an embodiment of the present disclosure.

Referring to FIGS. 1 to 3 according to an embodiment of the present disclosure, the present embodiment provides a voltage compensation circuit configured to provide data voltages for a display panel. The display panel includes a plurality of gate lines and a plurality of data lines intersecting with each other and defining pixel units at intersections thereof. The voltage compensation circuit of the present embodiment includes a counting unit, a voltage generation unit, a compensation voltage output unit and a power supply unit (i.e., power management IC). In the present embodiment, the counting unit is connected with a timing control unit of the display panel and the voltage generation unit, and configured to count rising edges output from the timing control unit and output a corresponding control signal based on the counted number (i.e., the number of periods of high level in CPV signal illustrated in FIG. 2) of the rising edges; the voltage generation unit is connected with the counting unit and the compensation voltage output unit, and configured to output a corresponding control voltage $V_f$ based on the control signal output from the counting unit; the compensation voltage output unit is connected with a feedback terminal FB and a voltage output terminal AVDD of the power supply unit and a low level terminal VSS, and configured to output a corresponding compensation voltage to the voltage output terminal AVDD based on the control voltage $V_f$ output from the voltage generation unit.

Here, it should be noted that the counting unit and the voltage generation unit of the present embodiment may be integrated in a controller.

Specifically, assuming that the gate lines of the display panel are scanned from top to bottom and it represents one gate line is scanned (i.e., pixel units under control of the gate line are turned on) every time the timing control unit outputs one rising edge, the counting unit counts the number of the rising edges output from the timing control unit, namely, the number of scanned gate lines is counted, and the counting unit outputs a corresponding control signal every time N (which is an integral equal to or larger than 1) rising edges are counted. For example, the timing control unit outputs five rising edges, and a count value of the counting unit reaches 5, and thus a first control signal is output; then, the timing control unit outputs another five rising edges and the counting unit counts the another five rising edges (i.e., a total counted number of the rising edges reaches 10), and thus a second control signal is output, and so forth. When the voltage generation unit receives the control signal from the counting unit, a control voltage $V_f$ is generated based on the control signal. For example, when the voltage generation unit receives the first control signal, a first control voltage is generated, and when the voltage generation unit receives the second control signal, a second control voltage is generated. At the same time, since the compensation voltage output unit is connected with the voltage generation unit, the compensation voltage output unit will generate a corresponding compensation voltage based on amplitude of the received control voltage $V_f$ (namely, the compensation voltage output unit outputs a first compensation voltage based on the first control voltage and outputs a second compensation voltage based on the second control voltage) and output the compensation voltage to the voltage output terminal AVDD of the power supply unit, so that the power supply unit provides a corresponding data voltage to the data line(s) of the display panel. Since the gate lines of the display panel are scanned from top to bottom, RC delay of the pixel units (i.e., pixel units scanned earlier) in an upper portion of the display panel is relatively large, while RC delay of the pixel units (i.e., pixels units scanned later) in a lower portion of the display panel is relatively small. In this case, the control voltage $V_f$ generated earlier by the voltage generation unit is larger than the control voltage $V_f$ generated later by the voltage generation unit (that is, the first control voltage is larger than the second control voltage), such that the compensation voltage output earlier from the compensation voltage output unit is larger than the compensation voltage output later from the compensation voltage output unit (namely, the first compensation voltage is larger than the second compensation voltage). The voltage compensation circuit in the present embodiment can achieve a substantially same charging rate for each row of pixel units by adjusting a charging voltage for each row of pixel units, so that the charging rate of the display panel in overall is uniform, and thus quality of product is improved.

In the present embodiment, as shown in FIG. 3, the compensation voltage output unit may include a first resistor R1, a second resistor R2, a third resistor R3, a fourth resistor R4 and a bipolar-junction transistor BJT.

Figure 4:
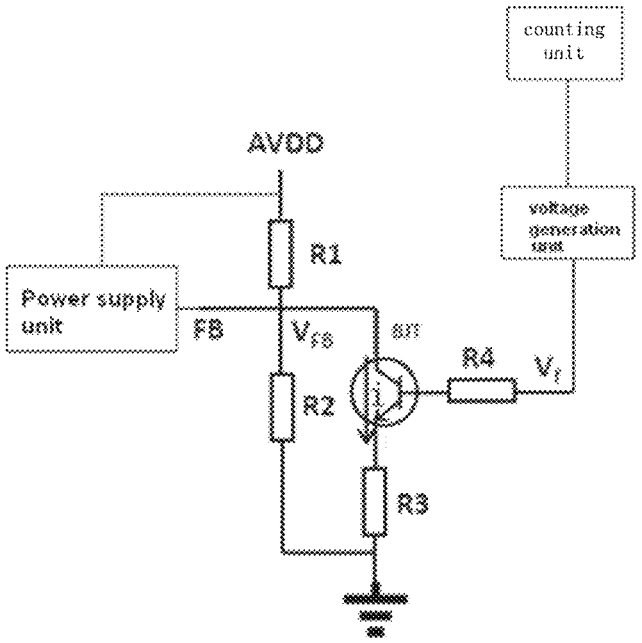
FIG. 4 is a schematic diagram illustrating a specific structure of a voltage compensation circuit according to an embodiment of the present disclosure.

Specifically, referring to FIG. 4, a first end of the first resistor R1 is connected with the voltage output terminal AVDD of the power supply unit, and a second end of the first resistor R1 is connected with a first end of the second resistor R2; a second end of the second resistor R2 is connected with a second end of the third resistor R3 and the low level terminal VSS; a first end of the third resistor R3 is connected with a second electrode of the bipolar-junction transistor BJT, and a second end of the third resistor R3 is connected with the low level terminal VSS; a first end of the fourth resistor R4 is connected with the voltage generation unit, and a second end of the fourth resistor R4 is connected with a control electrode of the bipolar-junction transistor BJT; and a first electrode of the bipolar-junction transistor BJT is connected with the feedback terminal FB of the power supply unit.

Specifically, when the control voltage $V_f$ generated by the voltage generation unit is output to the compensation voltage output unit, a current "I" flowing through the bipolar-junction transistor BJT is adjusted based on the amplitude of the generated control voltage $V_f$, such that a resistance of the bipolar-junction transistor BJT is adjusted. In addition, a voltage at the feedback terminal FB of the compensation voltage output unit has a fixed value, and optionally, $V_{FB}$=1.25 V. Needless to say, the voltage at the feedback terminal FB of the compensation voltage output unit may be set as required. Accordingly, the voltage at the voltage output terminal AVDD of the power supply unit can be calculated from following equation, $$V_{AVDD} = V_{FB}\left(1 + \frac{R1}{R2 \,//\, (R3 + R_{BJT})}\right),$$

where R1 represents a resistance of the first resistor R1, R2 represents a resistance of the second resistor R2, R3 represents a resistance of the third resistor R3, and $R_{BJT}$ represents the resistance of the bipolar-junction transistor BJT.

In a case where the gate lines of the display panel are scanned from bottom to top, in each frame, a value of the control voltage $V_f$ generated by the voltage generation unit is set to increase as the number of the scanned gate lines from bottom to top increases (namely, the number i of the rising edges (in the present embodiment, operating level being high level is described by way of example) counted by the counting unit increases); at this time, the resistance $R_{BJT}$ of the bipolar-junction transistor BJT in the compensation voltage output unit decreases, and $V_{AVDD}$ increases according to the above equation regarding the voltage at the voltage output terminal AVDD of the power supply unit. That is, in each frame, in a scanning process from bottom to top, $V_{AVDD}$ gradually increases, so that the charging rate of the display panel in overall is uniform, and in turn the brightness of the display panel is uniform.

In a case where the gate lines of the display panel are scanned from top to bottom, in each frame, a value of the control voltage $V_f$ generated by the voltage generation unit is set to decrease as the number of the scanned gate lines from top to bottom increases (namely, the number i of the rising edges (in the present embodiment, operating level being high level is described by way of example) counted by the counting unit increases); at this time, the resistance $R_{BJT}$ of the bipolar-junction transistor BJT in the compensation voltage output unit increases, and $V_{AVDD}$ decreases according to the above equation regarding the voltage at the voltage output terminal AVDD of the power supply unit. That is, in each frame, in a scanning process from top to bottom, $V_{AVDD}$ gradually decreases, so that the charging rate of the display panel in overall is uniform, and in turn the brightness of the display panel is uniform.

In the present embodiment, optionally, the counting unit is configured to clear the counted number of the rising edges when the scanning of a frame of an image is completed. That is, the counted number of the rising edges output from the timing control unit is cleared upon receiving a start vertical signal STV from the timing control unit. With this configuration, the operation of the counting unit is simplified.

Figure 5:
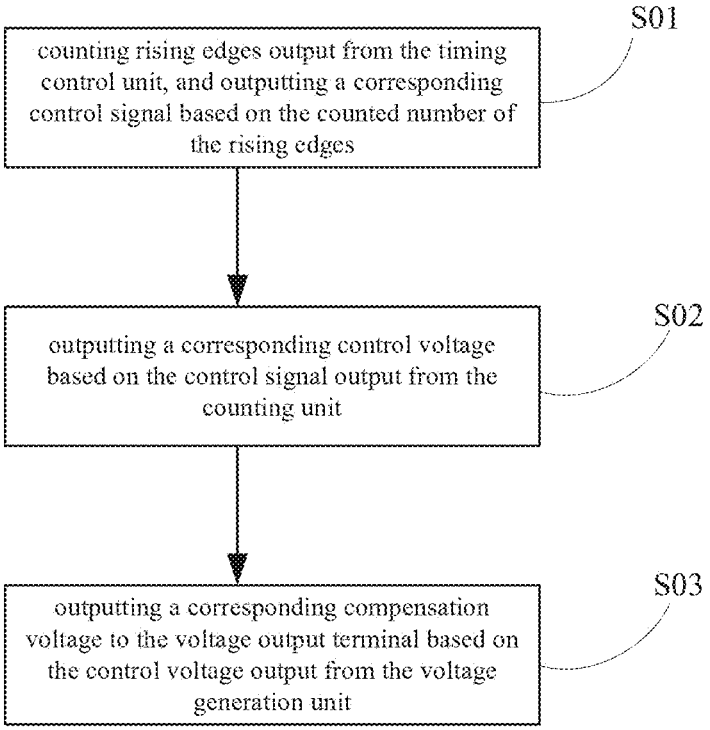
FIG. 5 is a flowchart illustrating a voltage compensation method of a voltage compensation circuit according to an embodiment of the present disclosure.

An embodiment of the present disclosure provides a voltage compensation method of a voltage compensation circuit, which may be the voltage compensation circuit in the first embodiment. Referring to FIG. 5, the voltage compensation method may include the following steps S01 to S03.

Step S01, counting rising edges output from the timing control unit, and outputting a corresponding control signal based on the counted number of the rising edges.

Specifically, assuming that the gate lines of the display panel are scanned from top to bottom and it represents one gate line is scanned (i.e., pixel units under control of the gate line are turned on) every time the timing control unit outputs one rising edge, the counting unit counts the number of the rising edges output from the timing control unit, that is, the number of scanned gate lines is counted, and the counting unit outputs a corresponding control signal every time N (which is an integral equal to or larger than 1) rising edges are counted. For example, the timing control unit outputs five rising edges and a count value of the counting unit reaches 5, and thus a first control signal is output; then, the timing control unit outputs another five rising edges and the counting unit counts the another five rising edges (i.e., the total counted number of the rising edges reaches 10), and thus a second control signal is output, and so forth.

Step S02, outputting a corresponding control voltage $V_f$ based on the control signal output from the counting unit.

Specifically, when the voltage generation unit receives the control signal output from the counting unit, a control voltage $V_f$ is generated based on the control signal. For example, when the voltage generation unit receives the first control signal, a first control voltage is generated, and when the voltage generation unit receives the second control signal, a second control voltage is generated.

Step S03, outputting a corresponding compensation voltage to the voltage output terminal AVDD based on the control voltage output from the voltage generation unit.

Specifically, since the compensation voltage output unit is connected with the voltage generation unit, the compensation voltage output unit will generate a corresponding compensation voltage based on the amplitude of the received control voltage $V_f$ (namely, the compensation voltage output unit outputs a first compensation voltage based on the first control voltage and outputs a second compensation voltage based on the second control voltage) and output the compensation voltage to the voltage output terminal AVDD of the power supply unit, so that the power supply unit provides a corresponding data voltage to the data line(s) of the display panel.

Since the gate lines of the display panel are scanned from top to bottom, RC delay of the pixel units (pixel units scanned earlier) in an upper portion of the display panel is relatively large, while RC delay of the pixel units (pixel units scanned later) in a lower portion of the display panel is relatively small. In this case, the control voltage $V_f$ generated earlier by the voltage generation unit is larger than the control voltage $V_f$ generated later by the voltage generation unit (namely, the first control voltage is larger than the second control voltage), such that the compensation voltage output earlier from the compensation voltage output unit is larger than the compensation voltage output later from the compensation voltage output unit (namely, the first compensation voltage is larger than the second compensation voltage). As such, the voltage compensation method in the present embodiment can achieve a substantially same charging rate for each row of pixel units by adjusting charging voltage for each row of pixel units, so that the charging rate of the display panel in overall is uniform, and quality of product is improved.

In the present embodiment, prior to step S01 (i.e., after step S03 for a previous frame), the method may further include a step S00 of clearing the counted number of the rising edges counted by the counting unit when the scanning of a frame of an image is completed. That is, as shown in FIG. 2, the counted number of the rising edges output from the timing control unit is cleared when a start vertical signal STV output from the timing control unit is received. With this configuration, the operation of the counting unit is simplified.

An embodiment of the present disclosure provides a display panel and a display apparatus, the display panel including the voltage compensation circuit described above.

Since the display panel includes the voltage compensation circuit described above, the display panel has a better display performance.

In the present embodiment, the display panel further includes a source driver IC, which is connected with the voltage output terminal AVDD of the power supply unit in the voltage compensation circuit and configured to provide data signals for the data lines of the display panel. Needless to say, the display panel may further include other structures such as a gate driver IC connected with the gate lines of the display panel, which are not described herein one by one.

The display apparatus provided in the present embodiment includes the above display panel. The display apparatus may be an electroluminescent display apparatus, or any product or component having a display function, such as an electronic paper, a mobile phone, a tablet computer, a television, a display, a notebook computer, a digital photo frame, a navigator, or the like.

It should be understood that the above implementations are merely exemplary implementations adopted for explaining the principle of the present disclosure, but the present disclosure is not limited thereto. For those skilled in the art, various modifications and improvements may be made without departing from the spirit and essence of the present disclosure, and these modifications and improvements are also considered to be within the protection scope of the present disclosure.

What is claimed is:

1. A voltage compensation circuit, comprising a counting circuit, a voltage generation circuit, a compensation voltage output circuit and a power supply circuit; wherein the counting circuit is connected with a timing controller of a display panel and the voltage generation circuit, and configured to count rising edges output from the timing controller and output a corresponding control signal based on the counted number of the rising edges, wherein the counted number of the rising edges represents a number of gate lines of the display panel that have been scanned line by line;

the voltage generation circuit is connected with the compensation voltage output circuit, and configured to output a corresponding control voltage based on the control signal output from the counting circuit; and the compensation voltage output circuit is connected with a feedback terminal and a voltage output terminal of the power supply circuit and a low level terminal, and configured to output a corresponding compensation voltage to the voltage output terminal based on the control voltage output from the voltage generation circuit, wherein the compensation voltage output circuit comprises a first resistor, a second resistor, a third resistor, a fourth resistor and a bipolar-junction transistor; wherein a first end of the first resistor is connected with the voltage output terminal of the power supply circuit, and a second end of the first resistor is connected with a first end of the second resistor;

a second end of the second resistor is connected with a second end of the third resistor and the low level terminal;

a first end of the third resistor is connected with a second electrode of the bipolar-junction transistor, and a second end of the third resistor is connected with the low level terminal;

a first end of the fourth resistor is connected with the voltage generation circuit, and a second end of the fourth resistor is connected with a control electrode of the bipolar-junction transistor; and a first electrode of the bipolar-junction transistor is connected with the feedback terminal of the power supply circuit.

2. The voltage compensation circuit of claim 1, wherein a voltage at the feedback terminal of the power supply circuit has a fixed value.

3. The voltage compensation circuit of claim 2, wherein the voltage at the feedback terminal of the power supply circuit is about 1.25V.

4. A voltage compensation method of a voltage compensation circuit, wherein the voltage compensation circuit is the voltage compensation circuit of claim 3, and the voltage compensation method comprises steps of:

counting rising edges output from the timing controller, and outputting a corresponding control signal based on the counted number of the rising edges;

outputting a corresponding control voltage based on the control signal output from the counting circuit; and outputting a corresponding compensation voltage to the voltage output terminal based on the control voltage output from the voltage generation circuit.

5. A display panel, comprising the voltage compensation circuit of claim 3.

6. A voltage compensation method of a voltage compensation circuit, wherein the voltage compensation circuit is the voltage compensation circuit of claim 2, and the voltage compensation method comprises steps of:

counting rising edges output from the timing controller, and outputting a corresponding control signal based on the counted number of the rising edges;

outputting a corresponding control voltage based on the control signal output from the counting circuit; and outputting a corresponding compensation voltage to the voltage output terminal based on the control voltage output from the voltage generation circuit.

7. A display panel, comprising the voltage compensation circuit of claim 2.

8. The voltage compensation circuit of claim 1, wherein the counting circuit is further configured to clear the counted number of the rising edges output from the timing controller upon receiving a start vertical signal from the timing controller.

9. A voltage compensation method of a voltage compensation circuit, wherein the voltage compensation circuit is the voltage compensation circuit of claim 8, and the voltage compensation method comprises steps of:

counting rising edges output from the timing controller, and outputting a corresponding control signal based on the counted number of the rising edges;

outputting a corresponding control voltage based on the control signal output from the counting circuit; and outputting a corresponding compensation voltage to the voltage output terminal based on the control voltage output from the voltage generation circuit.

10. A display panel, comprising the voltage compensation circuit of claim 8.

11. A voltage compensation method of a voltage compensation circuit, wherein the voltage compensation circuit is the voltage compensation circuit of claim 1, and the voltage compensation method comprises steps of:

counting rising edges output from the timing controller, and outputting a corresponding control signal based on the counted number of the rising edges;

outputting a corresponding control voltage based on the control signal output from the counting circuit; and outputting a corresponding compensation voltage to the voltage output terminal based on the control voltage output from the voltage generation circuit.

12. The voltage compensation method of claim 11, further comprising a step of:

clearing, by the counting circuit, the counted number of the rising edges output from the timing controller when the counting circuit receives a start vertical signal from the timing controller.

13. A display panel, comprising the voltage compensation circuit of claim 1.

14. The display panel of claim 13, further comprising a source driver IC connected with the voltage output terminal of the power supply circuit of the voltage compensation circuit.

15. A display apparatus, comprising the display panel of claim 13.

* * * * *